United States Patent [19]

Bergkvist

[11] Patent Number: 4,681,065

[45] Date of Patent: Jul. 21, 1987

[54] MULTIBED FLUIDIZED BED BOILER

[75] Inventor: Jörgen Bergkvist, Finspong, Sweden

[73] Assignee: ASEA STAL Aktiebolag, Finspong, Sweden

[21] Appl. No.: 879,052

[22] Filed: Jun. 26, 1986

[30] Foreign Application Priority Data

Jun. 28, 1985 [SE] Sweden ..... 8503222
Jan. 24, 1986 [SE] Sweden ..... 8600311

[51] Int. Cl.[4] ..... B09B 3/00
[52] U.S. Cl. ..... 122/4 D; 110/245; 110/341; 165/104.16; 422/142
[58] Field of Search ..... 122/4 D; 110/245, 341; 165/104.16; 422/142

[56] References Cited

U.S. PATENT DOCUMENTS 4,279,205 7/1981 Perkins et al. ..... 122/4 D X
4,476,816 10/1984 Cannon et al. ..... 122/4 D

*Primary Examiner*—Edward G. Favors
*Attorney, Agent, or Firm*—Watson, Cole, Grindle & Watson

[57] ABSTRACT

A multibed fluidized boiler having at least two fluidizable beds, in which conventional fuel, for example coal, is supplied to the first bed and in which the combustion of this fuel takes place in the first bed and in the following bed. An alternative fuel, such as wood chips, waste wood or paper, or combustible refuse, is adapted to be supplied to the second bed in order to be burnt there, thus obtaining a simplified fuel feeding to the second bed and increased protection against clogging of the nozzles for the supply of gas from the first bed to the second bed.

18 Claims, 7 Drawing Figures

MULTIBED FLUIDIZED BED BOILER

TECHNICAL FIELD

The present invention relates to a method of operating a multibed fluidized bed boiler having at least two fluidizable beds, in which a conventional fuel, for example coal, is supplied to the first bed and in which the combustion of this fuel takes place in this bed and in the one or more subsequent beds.

DISCUSSION OF PRIOR ART

A boiler of the above-mentioned kind is disclosed in U.S. Pat. No. 4,614,167. This patent describes a boiler plant with a multibed combustion chamber having a first bed in a lower combustion chamber space and a second bed in an upper combustion chamber space. The plant is provided with nozzles in the bottom members of each combustion chamber space for the injection of combustion air and combustion gases, respectively, for fluidizing the beds.

In the case of firing or additional firing with alternative fuels, such as waste wood, waste paper and combustible refuse, in this kind of boiler plant, there is a risk of the nozzle becoming clogged up owing to the nature of the alternative fuel.

SUMMARY OF THE INVENTION

One object of this invention is to avoid these problems and other problems associated therewith. A method of operating a boiler according to this invention, is characterized in that the alternative fuel (such as wood chips, waste wood, paper or combustible refuse) is supplied to the second bed to be burned there, thus obtaining a simpler fuel feeding to the second bed and increased protection against clogging of the nozzles for gas supplied from the first bed to the following bed. The lower back-pressure or counter pressure in the following bed facilitates the supply of alternative fuel where a subatmospheric pressure may prevail. Clogging of the nozzles from the first bed to the second bed can, in this way, be prevented.

The invention thus makes it possible to use fuels with a low calorific value, a high moisture content and fuel particles of varying shapes and sizes. Normally fuel particles of high moisture content and/or irregular size/shape are difficult to handle and transport. In the case of an uncooled second bed, it will be simpler to maintain the combustion temperature in the bed when such alternative fuels are used. In the case of firing being carried out in both beds, the flue gases from the first bed can be used to preheat the second bed and provide the necessary distribution of the pressure fall and a good fluidization in the second bed while additional air can be added as secondary air to the second bed. The nozzles in the bottom member of the second bed will not be subject to clogging owing to, for example, the alternative fuel having an irregular size fraction, since the alternative fuel is added to the second bed. The back-pressure in the boiler plant, is lower in and across the second bed, which permits a simpler fuel feeding with regard to the necessary pressure barrier. In the case of firing being performed only in the second bed, a certain minimum air flow is required in order to achieve the necessary distribution of the pressure flow between the nozzles in the bottom member of the second bed. By supplying flue gases below the bottom member of the second bed, the air flow and the firing load can be reduced further, while maintaining fluidization in the second bed.

BRIEF DESCRIPTION OF THE DRAWINGS

The invention will now be exemplified in greater detail, by way of example, with reference to the accompanying drawings, wherein.

DESCRIPTION OF PREFERRED EMBODIMENTS

Figure 1:
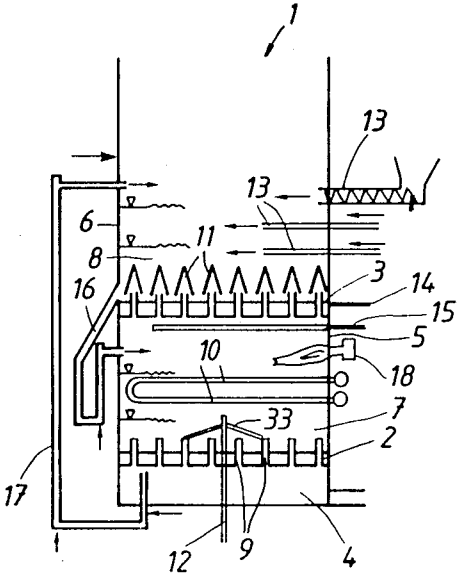
FIG. 1 shows a two-bed boiler according to the invention.

In FIG. 1, 1 designates a boiler having two cooled bottom members 2 and 3, which divide the combustion chamber 1 into an air distribution chamber 4, a first cooled fluidized bed 7 with a combustion chamber space 5 and a second uncooled fluidized bed 8 with a combustion chamber space 6. Primary combustion air is supplied to the first bed 7 via a number of nozzles 9 which fluidize the bed material in the bed 7 and provide the oxygen necessary for combustion of a major part of the supplied fuel.

The first bed 7 includes a nest of tubes 10 for cooling the bed material and heating water and/or steam and for other uses, as will be mentioned below. The bottom member 3 of the second bed 8 is provided with nozzles 11 through which combustion gases are supplied to the second bed 8 which fluidizes in the second combustion chamber space 6. The bottom member 3 is provided with means 14 for the supply of secondary air, the secondary air being fed with combustion gases into each respective nozzle 11.

During a firing operation using this boiler, a conventional fuel, normally coal, is supplied to the first bed 7 via duct 12 and a distributor 33 located in the bed 7. Normally, this fuel is supplied below the surface of the bed 7, and the material of the first bed 7 is normally an inert material with a certain amount of a sulfur-removing material. Ordinary bed material consists of coal ash, quartz sand and limestone or dolomite as the sulfur-removing material.

An alternative fuel (as described above) is supplied to the second bed 8 via a feeding means 13, which can be in the form of a screw conveyor, an automatic stoker, a drop shaft or a pneumatic feed. The alternative fuel is burnt in the bed 8 together with unburnt parts of the conventional fuel carried through from the first bed 7.

Flue gases from the fluid bed boiler may be fed back at 15 for increasing the temperature and reducing the pressure drop across the nozzles 11 leading to the second bed 8, for example in the case of little or no fuel being burnt in the first bed 7.

A reduced back-pressure in the space above the second bed 8 facilitates matters for the pressure barrier of the fuel supply. Separate firing in the second bed 8 requires a certain minimum air flow to achieve the necessary pressure flow distribution between the nozzles 11 at the second bottom member 3.

Hot water or steam may be fed through the tube nest 10 in the first bed 7, and this provides preheating of the air to the bottom member 3 of the second bed 8. Bed material can also be recirculated between the beds via conduits 16 and 17. Preheating of the second bed 8 can be accomplished by means of this method, while at the same time power can be extracted from the boiler 1 via the tube nest 10 in the first bed 7.

Above the second bed 8, a sub-atmospheric pressure can be maintained. This facilitates the fuel supply because hot flue gases cannot then flow backwards into the fuel system.

The nozzles, for example the nozzles 11, are designed to operate with a certain pressure drop. If the first bed 7 is cold, the pressure drop and degree of fluidization will be reduced, additional heating can be provided in the first bed 7, for example by feeding in flue gases (at 15).

The boiler 1 can be started by heating the second bed 8 using a pilot burner 18, the hot gases from which heat the bed 8 to the required ignition temperature. Hot bed material can then be transported from the second bed 8 to the first bed 7, this hot material causing fuel fed in via the distributor 33 to ignite in the first bed 7.

The pilot burner 18 can also be used after start-up for preheating the second bed 8, for example in the case of the use of moist fuels.

The combustion gases leaving the second bed 8 are supplied, in the usual manner, to a waste heat boiler (not shown) located downstream of the combustion chambers.

Fuel additives, such as a sulfur remover, can also be supplied, e.g. via the feeding means 13 for the alternative fuel.

Figure 2:
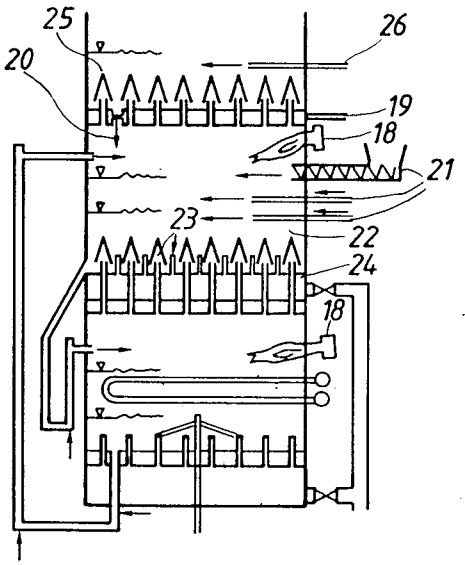
FIG. 2 shows a three-bed boiler according to the invention, and FIGS. 3 (*a&b*), 4*a&b*) and 5 show alternative uses of the three-bed boiler shown in FIG. 2.

FIG. 2 shows a three-bed boiler, in which fuel additive is supplied at 26 and secondary or tertiary air is supplied at 19. Numeral 20 shows an emptying device for the third bed 25. A similar emptying device 20 can also be provided for the second bed 22. The alternative fuel is supplied via one of the feeding means 21 to the second bed 22. Installing a third bed and providing the second bed with an air plenum (see at 24) affords improved possibilities of varying the load range. Start-up of the three-bed boiler can be performed in the second bed 22. The second bed 22 and the third bed 25 are each provided with means for supplying secondary air. The advantages of the three-bed boiler in the case of firing in the second bed are as follows:

1. Sparks leaving the second bed are extinguished in the third bed.
2. There are improved possibilities for desulfurization.
3. Combustion is effected in three stages.
4. Ignition of the boiler is simplified via a pilot burner in both the first and the second bed.
5. Firing at a continuous low load can be performed using the second bed.
6. In the case of a high load, firing can be carried out in both the first and the second beds.
7. The amounts of nitrogen oxides in the flue gases can be reduced by using three-stage combustion with low initial temperature and excess air in the uppermost combustion bed.

In the bottom member of the second bed 22—in the three-bed alternative—combustion gas and fluidizing air are fed separately as shown at 23; in the two-bed case, a common feed is employed. In the three-bed alternative, the secondary air fed to the second bed 22 is used primarily for cleaning and as tertiary air, since other air is supplied to the plenum (at 24) which also can be used as secondary air. In the two-bed case, the provision of the secondary air has a twofold function, namely, for cleaning the nozzles and for use as secondary air.

Figure 3:
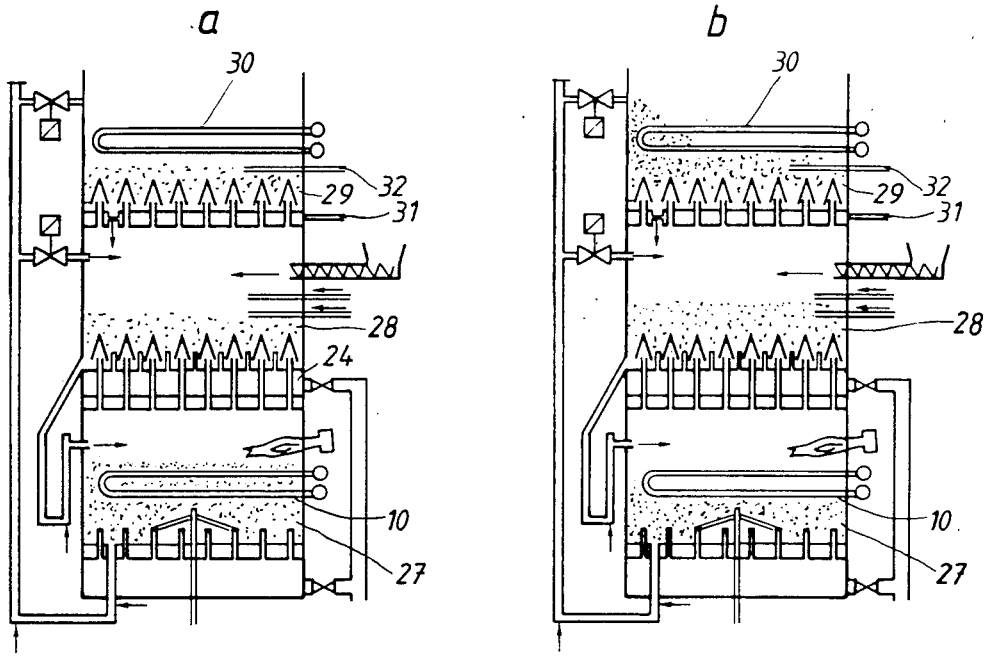

FIGS. 3*a* and 3*b* show a three-bed boiler designed for firing with coal only. The three beds 27, 28, 29 are located in series in the order just mentioned.

FIG. 3*a* shows the boiler operating at maximum load and fired with coal only, The first bed 27 is fully fluidized, and thus the nest of tubes 10 is submerged in the bed material, whereas the nest of tubes 30 in the third bed 29 is not contacted by bed material. Secondary and tertiary air are fed in either at 31 or 24, and fuel and/or sulfur remover can also be fed in at 32. This is done to suit the flue gas temperature of the subsequent waste heat boiler (not shown) and to control the emission levels concerning $NO_x$ and CO.

FIG. 3*b* shows the corresponding conditions in the case of minimum load. In this case, the bed height of the first bed 27 is reduced, and if fines even at higher loads (i.e. finely-crushed particles) are included in the fuel, also the combustion can be moved upwards in the boiler, then it is possible to keep normal exhaust temperature to the waste heat boiler by regulating the bed height of the third bed 29 so that more or less energy is withdrawn by the tube nest 30.

Figure 4:
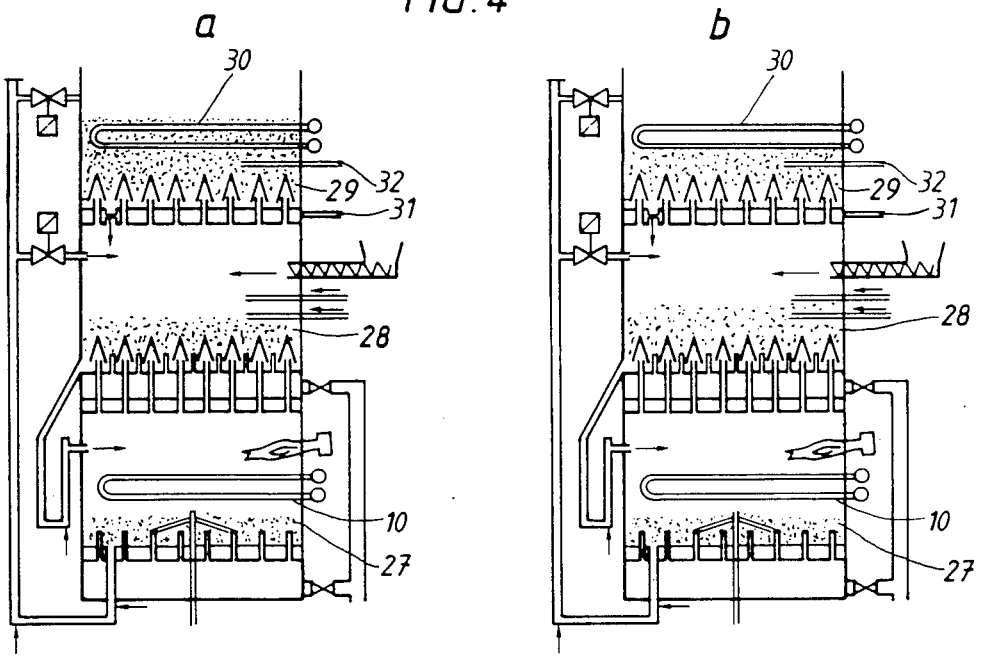

In FIGS. 4*a* and 4*b*, the conditions in the case of maximum load are shown in 4*a* and the conditions in the case of minimum load are shown in FIG. 4*b*, when firing by means of biofuel firing only is performed. In the maximum load case (FIG. 4*a*), the tube nest 10 of the first bed 27 is exposed and the tube nest 30 of the third bed 29 is overfluidized. In the minimum load case (FIG. 4*b*), on the other hand, the tube nests of the first bed 27 as well as of the third bed 29 are exposed (completely or partially). The power output can be controlled, and adaptation to the flue gas temperature of the waste heat boiler can be made.

Figure 5:
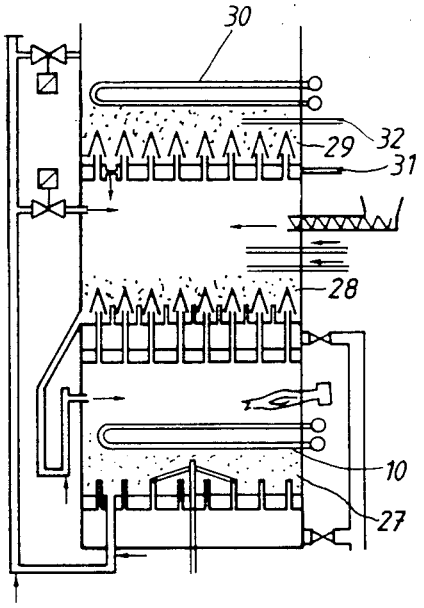

FIG. 5 shows firing in a three-bed boiler (27–29) using a combination of coal firing and biofuel firing. In this case, the bed heights in the first 27 and third 29 beds are adjusted top meet the requirements of the waste heat boiler.

Material from the second bed 28 can be removed to the third bed 29 via the first bed 27.

Combustion in stages can be achieved by adding complementary combustion air to the bottom member of the second bed 28 and the third bed 29 simultaneously during firing in the first bed 27.

Alternatively, secondary air can be fed to the bottom member of the third bed 29 during firing in the second bed 28 only.

During firing in both the first bed 27 and the second bed 28, the air can be adjusted so as to attain combustion in stages. Secondary air is added via the bottom members of the second bed 28 and the third bed 29.

The boilers described in the foregoing description can be varied in many ways within the scope of the following claims.

For the three bed alternative according to FIGS. 2, 3, 4 and 5, a bed material transport means (such as that shown at 17 in FIG. 1) can also be used for transporting bed material between the second bed for transportation to the third bed.

I claim:

1. A method of operating a multibed fluid bed boiler having at least two fluidizable beds aranged one after the other, in which conventional fuel is supplied to the first bed and in which the combustion of this fuel takes place in the first bed and in at least the immediately following bed, comprising the steps of supplying an alternative fuel to the second bed in order to be burnt there, thus obtaining a simplified fuel feed to the second bed as well as increased protection against clogging of nozzles supplying gas from the first bed to the second bed, and feeding flue gas from a following bed into the combustion space above the first bed for increasing the temperature and the fall of pressure across the nozzles supplying gas to the second heel in the event of low or no combustion in the first bed.

2. A method as claimed in claim 1, in which the alternative fuel is one of woodchips, waste wood, waste paper and combustible refuse.

3. A method of operating a multibed fluid bed boiler having at least three fluidizable beds arranged one after the other, in which conventional fuel is supplied to the first bed and in which combustion of this fuel takes place in the first bed and in at least the immediately following bed, comprising the steps of supplying an alternative fuel to the second bed in order to be burnt there, thus obtaining a simplified fuel feed to the second bed as well as increased protection against clogging of nozzles supplying gas from the first bed to the second bed, the firing being adapted to be carried out in these beds, whereby in the first bed only coal firing is carried out, the power output of the boiler being controlled by varying the degree of fluidization and bed height of the first bed relative to a first nest of tubes supported adjacent to the first bed, supporting a second nest of tubes adjacent to the third bed and being either completely exposed or at least partially submerged by the third bed, the first nest of tubes being exposed to a corresponding extent in those cases where the conventional fuel partially contains finely-crushed particles.

4. A method according to claim 3, wherein biofuel is supplied to the second bed, and the power output is modified by varying the degree of fluidization and bed height of the third bed relative to the second nest of tubes.

5. A method according to claim 3, wherein coal is fed into the first bed and biofuel is fed into the second bed, the degrees of fluidization and bed heights of the first and third beds being adapted to the nest of tubes supported, respectively, adjacent to the first and third beds.

6. A method of operating a multibed fluid bed boiler having at least two fluidized beds arranged one after the other, in which conventional fuel is supplied to the first bed and in which the combustion of this fuel takes place in the first bed in at least the immediately following bed, comprising the steps of supplying an alternative fuel to the second bed in order to be burnt there, thus obtaining a simplified fuel feed to the second bed as well as increased protection against clogging of nozzles supplying gas from the first bed to the second bed, providing a third bed after the second bed, whereby conventional fuel can also be supplied to the second bed with the alternative fuel, thus obtaining an increased possibility of low load operation.

7. A method of operating a multibed fluid bed boiler having at least two fluidized beds arranged one after the other, in which conventional fuel is supplied to the first bed and in which the combustion of this fuel takes place in the first bed in at least the immediately following bed, comprising the steps of supplying an alternative fuel to the second bed in order to be burnt there, thus obtaining a simplified fuel feed to the second bed as well as increased protection against clogging of nozzles supplying gas from the first bed to the second bed, operating at least one pilot burner, opening out into the first bed, after start-up in order to control the fall of pressure across the nozzles leading to the second bed to enhance the heating effect in the second bed.

8. A method according to claim 1, further comprising the step of operating at least one pilot burner, opening out into the first bed, after start-up in order to control the fall of pressure across the nozzles leading to the second bed to enhance the heating effect in the second bed.

9. A method according to claim 6, further comprising the step of operating at least one pilot burner, opening out into the first bed, after start-up in order to control the fall of pressure across the nozzles leading to the second bed to enhance the heating effect in the second bed.

10. A method according to claim 1, in which a fuel additive is supplied to one of the beds.

11. A method according to claim 6, in which a fuel additive is supplied to one of the beds.

12. A method according to claim 7, in which a fuel additive is supplied to one of the beds.

13. A method according to claim 1, in which bed material from the second bed is supplied to the first bed and vice versa.

14. A method according to claim 3, in which the first nest of tubes contains water and/or steam and the output of the first nest of tubes is used as a heating source.

15. A method according to claim 3, in which means is provided to permit material from the second bed to be transferred to the third bed via the first bed.

16. A method according to claim 3, in which complementary combustion air is supplied simultaneously to the bottom of the second bed and the third bed during firing in the first bed.

17. A method according to claim 3, in which secondary air is supplied to the second bed only.

18. A method according to claim 3, in which during firing in the first bed and second bed, the combustion air is adjusted so as to obtain combustion in all three beds, secondary air being supplied to the bottom of the third bed.

* * * * *